United States Patent [19]

Elson

[11] Patent Number: 4,591,318

[45] Date of Patent: May 27, 1986

[54] DUAL COMPRESSORS

[75] Inventor: John P. Elson, Sidney, Ohio

[73] Assignee: Copeland Corporation, Sidney, Ohio

[21] Appl. No.: 712,510

[22] Filed: Mar. 18, 1985

Related U.S. Application Data

[60] Continuation of Ser. No. 491,542, May 4, 1983, abandoned, which is a division of Ser. No. 231,016, Feb. 3, 1981, Pat. No. 4,396,360.

[51] Int. Cl.[4] ..... F04B 39/12

[52] U.S. Cl. ..... 417/312; 417/363; 417/902

[58] Field of Search ..... 417/902, 372, 540, 312, 417/426–428, 360, 363

[56] References Cited

U.S. PATENT DOCUMENTS

| | | | |
|---|---|---|---|
| 4,086,032 | 4/1978 | Nishioka | 417/902 |
| 4,105,374 | 8/1978 | Scharf | 417/902 |
| 4,205,537 | 6/1980 | Dubberly | 417/902 |
| 4,277,955 | 7/1981 | Parker | 417/902 |
| 4,313,715 | 2/1982 | Richardson | 417/902 |
| 4,358,254 | 11/1982 | Hannibal | 417/246 |
| 4,412,791 | 11/1983 | Lal | 417/902 |

*Primary Examiner*—Carlton R. Croyle
*Assistant Examiner*—Theodore W. Olds
*Attorney, Agent, or Firm*—Harness, Dickey & Pierce

[57] ABSTRACT

A hermetic refrigeration compressor system comprises a sealed shell containing two motor-compressor units of different capacities and also containing a suction gas accumulator through and from which suction gas is delivered to both units, the interior of the shell being at suction pressure; gas from an outlet of the accumulator being directed into an aligned, spaced inlet in the motor cover of the smaller unit. Both units are spring-mounted on a unitary support within the shell.

9 Claims, 5 Drawing Figures

DUAL COMPRESSORS

This is a continuation of application Ser. No. 491,542, filed May 4, 1983, abandoned, which in turn is a divisonal of application Ser. No. 231,016 filed Feb. 3, 1981, now U.S. Pat. No. 4,396,360.

BACKGROUND OF THE INVENTION

Air conditioning systems which are operable in a reversed cycle mode, for heating a served zone, as well as operable in the normal cooling mode, require the high side of the system to accommodate conditions not normally encountered in systems designed only for cooling. In order to reduce the danger of undesirable entry of liquid into the compressor(s) as a result of the increased charge of refrigerant, the use of a suction gas accumulator has become advisable. It has also been found that a system incorporating a plurality of compressors connected in parallel in the same system and which can be cycled separately, so as to function individually or collectively, provides an efficient and desirable method of varying the high side compression to match the load.

The overall object of the present invention is to provide an improved hermetic multi-compressor assembly suitable for reversible-cycle ("heat pumps") applications, incorporating compressors of different capacities and having an internal suction gas accumulator through which the compressors are supplied, and which forms a part of a directed suction inlet system for one or more of the compressors. A further object is to provide an improved suspension system for a dual compressor hermetic unit.

Other objects and advantages of the invention will become apparent to persons skilled in the art upon consideration of this disclosure.

BRIEF DESCRIPTION OF THE FIGURES OF DRAWING

FIG. 6 is a plan view of a hermetic dual compressor unit in accordance with the present invention with portions thereof broken away.

DETAILED DESCRIPTION OF PREFERRED FORM OF THE INVENTION

Figure 1:
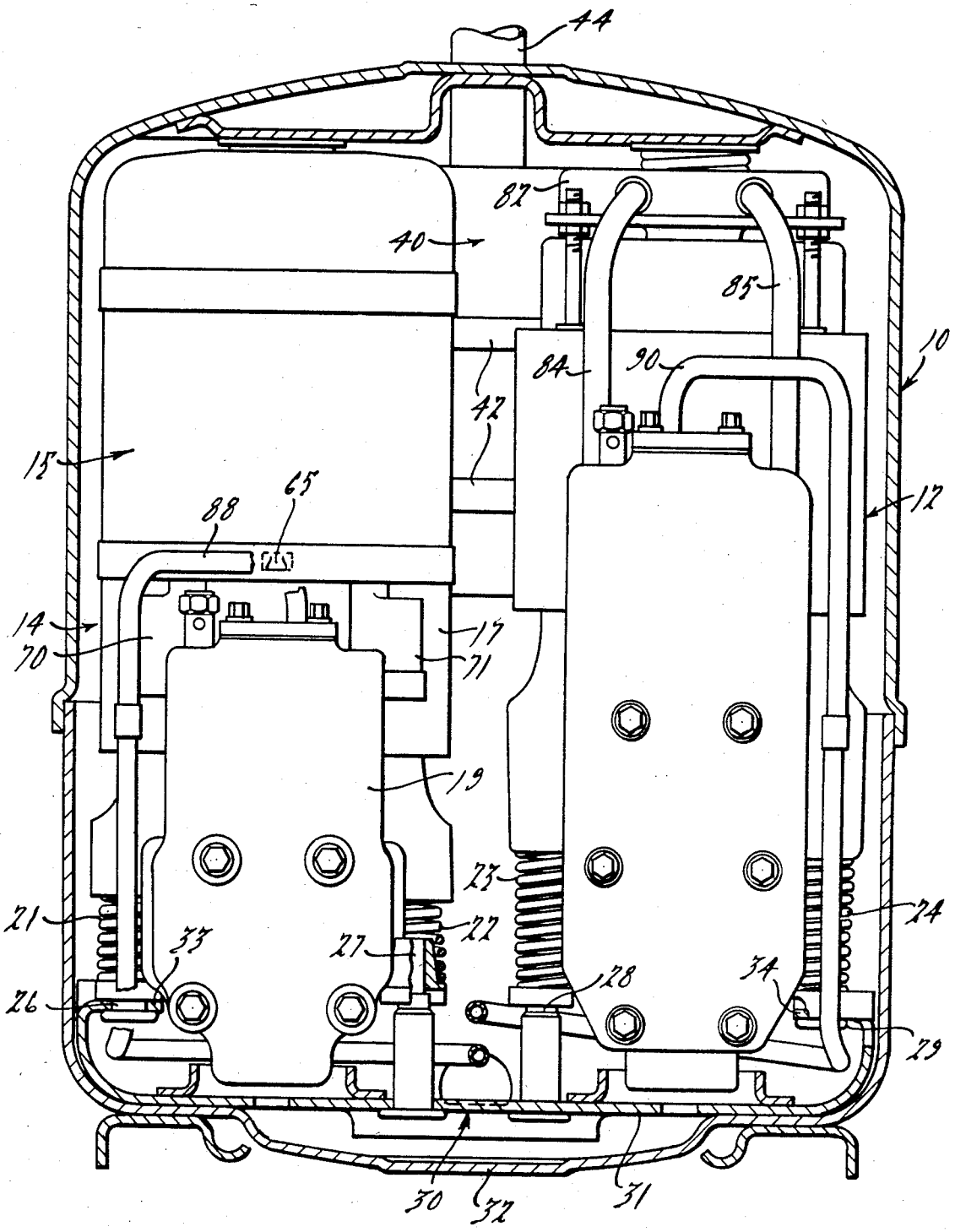
FIG. 1 is a vertical sectional elevational view of a hermetic dual compressor unit constructed in accordance with the present invention.
Figure 2:
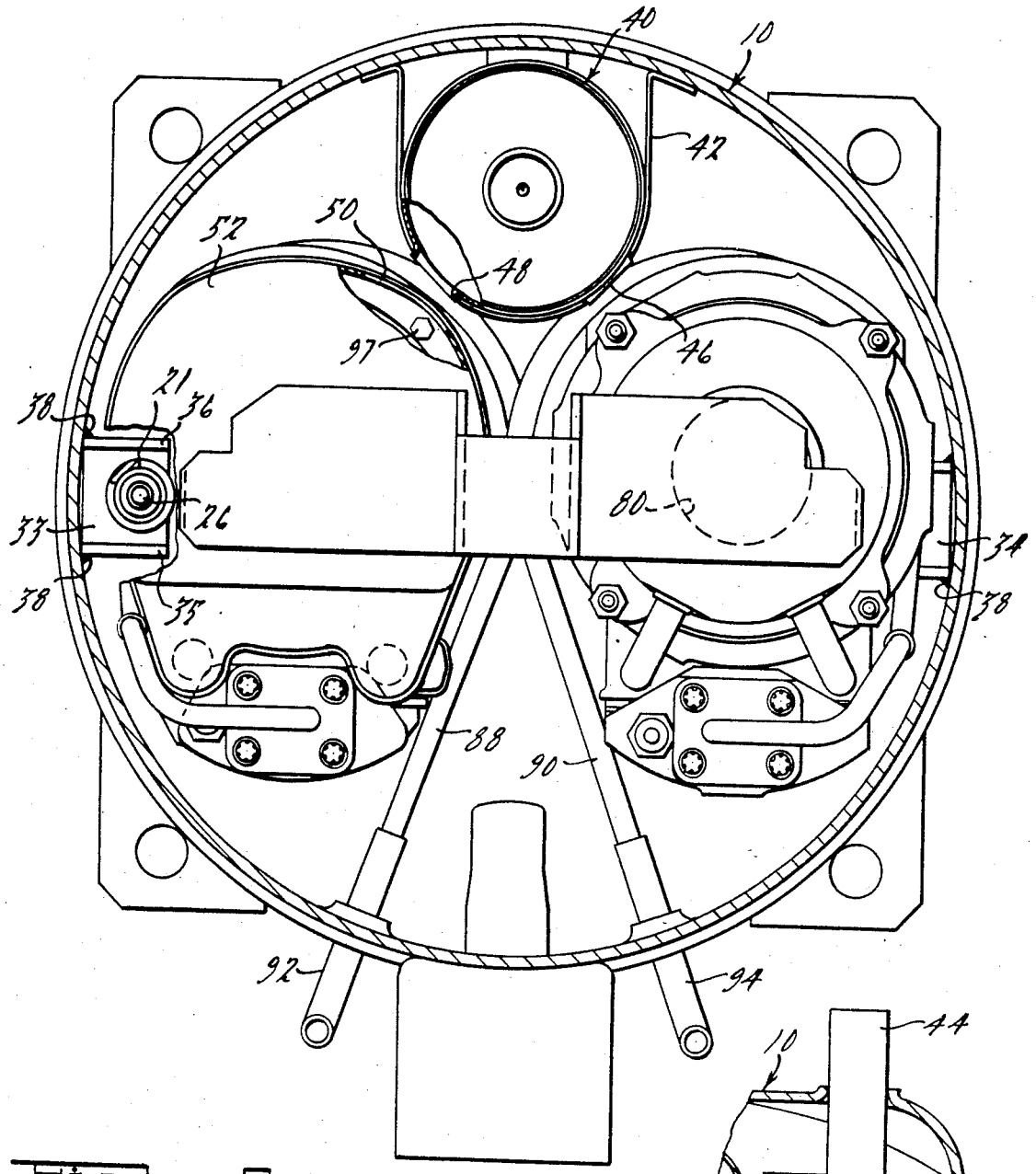
FIG. 2 is a plan view with the top of the shell broken away.
Figure 3:
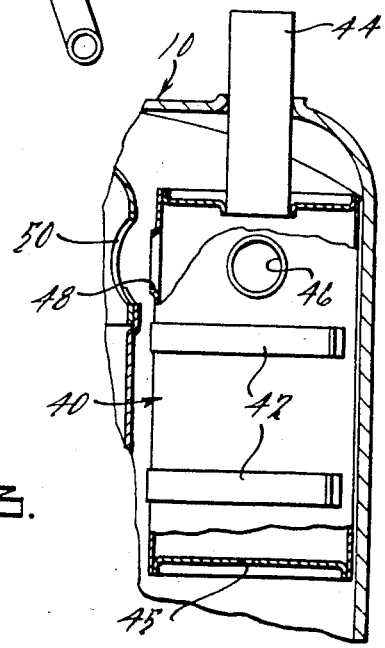
FIG. 3 is a cross-sectional view taken substantially on the line III–III of FIG. 2 and looking in the direction of the arrows.

Reference character 10 designates generally a hermetically sealed sheet metal casing or shell, the construction of which is essentially conventional and will require no detailed description. Two motor compressor units are mounted in the shell, comprising a higher capacity unit 12 and a lower capacity unit 14. The unit 12 is a known conventional unit of a type in commercial production. The smaller unit 14 is also a standard commercial unit with the exception of the motor cover or shroud 15, which has been elongated to make the height of the unit 14 substantially the same as that of unit 12.

The units are supported from beneath by helical compression springs 21, 22, 23, 24, the lower ends of which are supported and positioned by spring abutment posts 26, 27, 28, 29. Posts 26–29 are carried by a bracket 30 formed as a heavy sheet metal strap having a flat bottom portion 31 lying on and extending across the bottom of the shell and bridging the depressed central portion 32 of the oil sump area. The end portions of the bracket 30 extend upwardly close to the inner walls of the shell for a short distance and then inwardly to define shelf portions 33, 34 which support the outer posts 26 and 29. Each of the shelf portions 33, 34 has upturned stiffening sidewall flanges 35, 36 the outer ends of which are welded to the shell wall, as indicated at 38.

Also contained within the shell 10 is a suction gas accumulator 40 formed as cylindrical sheet metal container attached by means of welded straps 42 to the shell wall near the top and close to both units but spaced sufficiently to avoid contact during vibration of the units. Returning suction gas is delivered to the accumulator 40 via an inlet tube 44 which extends downwardly through the top of the shell into the accumulator, to discharge gas downwardly into the accumulator. Any liquid content is projected toward the bottom of the accumulator and can escape into the shell through a small drain hole 45. The accumulator is provided with two outlet openings 46 and 48 in its sidewall near the top. Opening 46 discharges directly into the shell. Although the outlet 48 also opens into the shell, it is positioned close to and in axial alignment with a somewhat larger opening 50 in the cover assembly 15.

Figure 4:
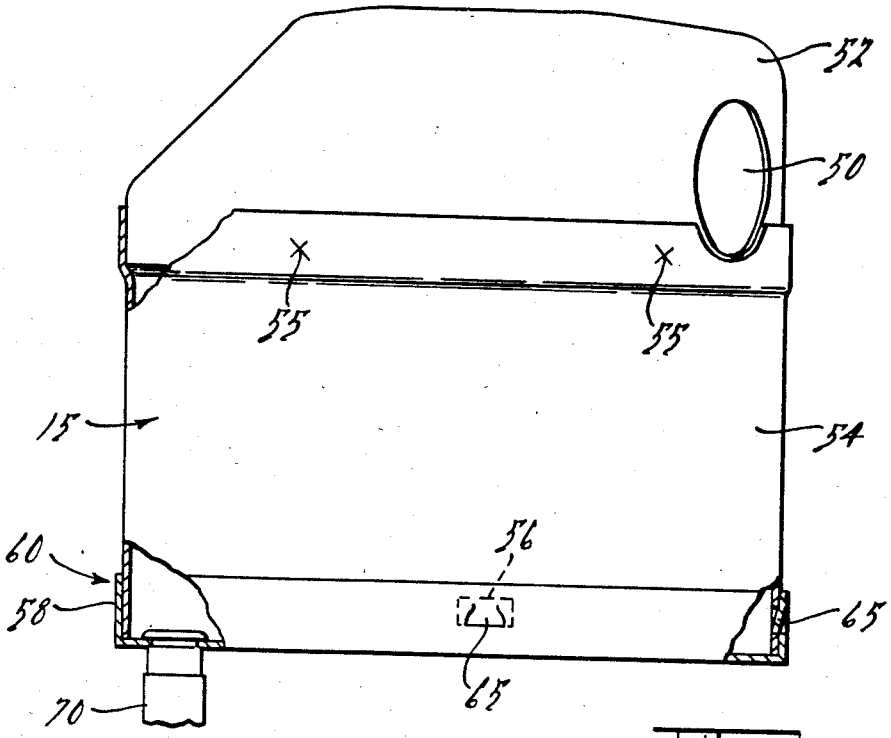
FIG. 4 is a side elevational view, partly broken away, of the motor cover and its retaining means as employed on the smaller-motor compressor unit.
Figure 5:
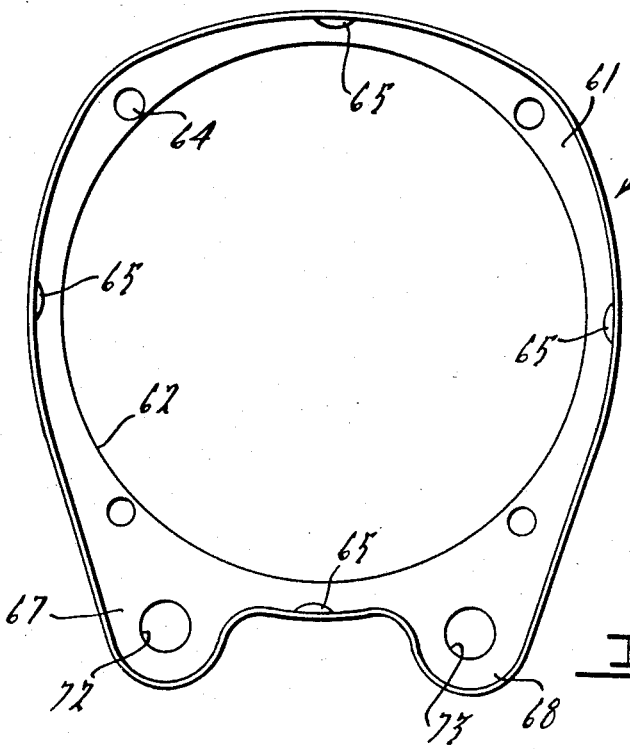
FIG. 5 is a plan view of the cover retainer.

The cover assembly 15 defines an enclosure with and above the top of the motor portion 17 of the smaller compressor unit 14 and receives suction gas through opening 50. As shown in FIGS. 1 and 4, the cover assembly is formed in two parts, comprising an upper portion 52 and a lower portion 54. Upper portion 52 comprises the standard cover which is normally attached directly to the top of the motor 17 when compressors corresponding to the smaller unit 14 are installed individually in smaller shells proportioned to receive them. The lower portion 54 comprises an extension sleeve, the upper portion of which is swaged outwardly to telescopically receive the lower end of the cover portion 52 which it accurately fits and to which it is secured by spot welding at a plurality of positions as 55. At its lower end the extension sleeve 54 is provided with a plurality of rectangular openings 56 spaced at suitable intervals therearound.

The lower end of the extension sleeve is proportioned to telescopically fit into the upstanding peripheral flange 58 of a retainer 60 which is secured to the upper end of the electric motor 17, preferably by means of the bolts which secure the motor stator assembly to the compressor body. The bottom flange portion 61 of the retainer, which has a circular opening 62 therein, is proportioned to encircle the end turns of the field winding and rest on the top of the field iron assembly, the retainer being provided with holes 64 in flange 61 through which the stator securing bolts 97 extend. The vertical peripheral flange 58 of retainer 60 is provided with a plurality of tongues 65 struck inwardly therefrom and positioned to project into the apertures 56 and overlie the bottom edges of such apertures to retain the extension sleeve and cover assembly in position. The inner surfaces of tongues 65 slant inwardly, as shown in FIG. 4, so that the cover assembly may be attached simply by pushing it downwardly into position, the apertured portions of the sleeve 54 being resiliently cammed inwardly during such movement and then snapping outwardly to interengage the tongues 65. This general method of attaching the cover, which permits the stator and rotor portions of the induction type electric motor 17 to be adjusted, gapped and permanently locked with relation to each other prior to the attachment of the cover, is considered in greater detail in the co-pending application of Ernest R. Bergman, Ser. No. 70,325, filed Aug. 27, 1979.

It will be appreciated that top cover portion 52 may if desired be secured to the sleeve 54 by a similar interlocking tongue and slot connection arrangement which can be snapped together in like fashion, rather than by means of the spot welds 55.

The bottom flange 61 of the retainer 60 is provided with extension portions 67 and 68 at two spaced positions which overlie the upper end of the compressor head and muffler assembly 19 of the compressor and to define a wall which completes a bottom closure wall for the space within the cover assembly 15. A pair of combined suction tube and muffler portions 70, 71 communicate through apertures 72, 73 in flange extension portions 67, 68 with the interior of the cover assembly, to conduct suction gas to the compressor inlet in known manner.

In the preferred construction illustrated, suction gas for the larger motor compressor assembly 12 is drawn from the interior of the shell through a top opening 80 in cover portion 82, from which it is conducted to the compressor through suction tubes 84, 85, these parts also being conventional and well known in the art.

No modification of the standard commercial larger unit 12 is thus required, although it will be recognized that the cover portions of unit 12 could also include a suction inlet opening aligned with the outlet 46 of the accumulator, to provide a directed suction inlet for the larger unit 12, as well as for the smaller unit. The increased efficiency of the smaller unit made possible by the suction inlet is of greater importance than such an inlet for the larger unit, inasmuch as the smaller unit operates continuously or for a greater proportion of operating time.

The discharge tubes 88, 90 for the respective units 12, 14 are connected to the exterior through separate discharge connector nipple portions 92, 94 in order to provide the longest and most resilient discharge tube portions feasible, but it will be appreciated that these could be connected together within the shell or connected to a single discharge nipple if desired.

The accumulator is preferably proportioned to hold 75 percent of the total refrigerant charge. The construction of the accumulator and its location in the interior of the shell where it can be heated by the motor-compressor units help to prevent liquid constituents from entering the compressors. This arrangement also permits the use of efficient directed suction inlet systems, and insures that a suction accumulator will in fact be incorporated in the system, which, as noted, is particularly important in systems designed for heat pump applications.

It will be understood that all closed circulatory systems wherein heat is absorbed from one area by evaporation of a liquid and is conducted to another area for use or disposal, and for recompression of the gas, can properly be described as "heat pumps", and are so regarded herein, regardless of whether the system acts to heat or to cool the served zone.

This Detailed Description of the Preferred Form of the Invention and the accompanying drawings have been furnished in compliance with the statutory requirement to set forth the best mode contemplated by the inventor of carrying out the invention. The prior portions consisting of the "Abstract of the Disclosure" and the "Background of the Invention" are furnished without prejudice to comply with administrative requirements of the Patent and Trademark Office.

While a preferred embodiment of the invention has been described herein, it will be appreciated that various modifications and changes may be made without departing from the spirit and scope of the appended claims.

I claim:

1. In a multi-compressor assembly including a housing having top and bottom walls and two vertically mounted motor-compressors of differeing height therein, each of said motor-compressors comprising a compressor at the bottom and an electric motor at the top, each of said motor-compressors having a motor cover rigidly attached thereto and extending upwardly therefrom, the height of the motor cover of the shorter motor-compressor exceeding the height of such motor-compressor sufficiently to substantially compensate for the differing height of said motor-compressors, and means for resiliently supporting said motor-compressors including means engaging the cover of the shorter motor-compressor and the topwall.

2. A multi-compressor assembly as defined in claim 1 for refrigeration service wherein the housing is of the gas-tight type, a suction gas accumulator in the housing adjacent to but spaced from the cover of the shorter motor-compressor, a suction gas inlet extending into the accumulator from outside the housing, an inlet orifice for the shorter motor-compressor comprising an opening in the side of said cover facing the accumulator, and a directed suction outlet orifice in said accumulator aligned with said inlet orifice in the cover for discharging suction gas into the cover.

3. A multi-compressor assembly as defined in claim 1 wherein said motor cover of the shorter motor-compressor includes an extension sleeve and a cover member, said extension sleeve having one end secured to said motor compressor, said cover member being secured to the other end thereof.

4. A multi-compressor assembly as defined in claim 1 wherein said motor-compressors are of different pumping capacities and each motor-compressor includes an inlet within the housing and means for supplying refrigerant to said inlets comprising a suction gas accumulator in said housing.

5. A multi-compressor assembly as defined in claim 4 further comprising outlet ports in the accumulator for each of said compressor inlets, said outlet ports being located in an upper portion of said accumulator, and one of said outlet ports being open into the housing, one of said compressor inlets comprising a port spaced from but aligned with said outlet port which opens into the housing.

6. A multiple compressor system as defined in claim 4 including an inlet which opens into said accumulator from outside the housing, means for supplying suction gas from the accumulator to one of said compressors comprising spaced aligned outlet and inlet ports including an outlet port in the accumulator and an inlet port for, and which is appurtent to, said one of the compressors.

7. A multiple compressor system as defined in claim 4 including an inlet which opens into said accumulator from outside the housing, means for supplying suction gas from the accumulator to each of said compressors comprising spaced aligned outlet and inlet ports including an outlet port in the accumulator and an inlet port for, and which is appurtent to, each said compressor.

8. A multiple compressor assembly as defined in claim 4 wherein said accumulator extends vertically within the housing, an inlet which opens downwardly into said accumulator from outside the housing, and means for supplying suction gas from the accumulator to each of said compressors comprising an outlet opening in the accumulator for the inlet of each of said compressors, said outlet openings being located in an upper portion of the accumulator.

9. A multiple compressor system as defined in claim 8 wherein at least one of said outlet openings is spaced from, aligned with and directed toward an inlet opening for, and which is appurtenant to, one of said compressors.

* * * * *